US006298903B1

(12) United States Patent
Wyser et al.

(10) Patent No.: US 6,298,903 B1
(45) Date of Patent: Oct. 9, 2001

(54) METHOD AND APPARATUS FOR VENTING A DIECASTING MOULD OF A DIECASING MACHINE

(75) Inventors: Johann Wyser, Ligerz; Heinrich Guth, Vevey, both of (CH)

(73) Assignee: Fondarex SA, Montreux (CH)

( * ) Notice: Subject to any disclaimer, the term of this patent is extended or adjusted under 35 U.S.C. 154(b) by 0 days.

(21) Appl. No.: 09/246,485

(22) Filed: Feb. 9, 1999

(30) Foreign Application Priority Data

Feb. 19, 1998 (SE) ..... 0399/98

(51) Int. Cl.[7] ..... B22D 17/00
(52) U.S. Cl. ..... 164/305; 164/410; 164/312
(58) Field of Search ..... 164/113, 305, 164/410, 312

(56) References Cited

U.S. PATENT DOCUMENTS 5,488,985 * 2/1996 Wyser ..... 164/305

FOREIGN PATENT DOCUMENTS 58-112647 * 7/1983 (JP) ..... 164/305
64-66058 * 3/1989 (JP) ..... 164/305

* cited by examiner

*Primary Examiner*—Nam Nguyen
*Assistant Examiner*—I.-H. Lin
(74) *Attorney, Agent, or Firm*—Tarolli, Sundheim, Covell, Tummino & Szabo L.L.P.

(57) ABSTRACT

In order to vent a diecasting mold of a diecasting machine, it is proposed that the mold cavity and/or the pressure chamber are vented during the filling operation by a second venting valve, additionally to a first venting valve. The first venting valve is located in a venting channel portion that communicates with a venting channel leading out of the mold cavity. For operating the first venting valve, an impact transmitter is provided that is operationally connected to the first venting valve and that is exposed to and moved by the casting material advancing from the mold cavity to the venting channel. The second venting valve is operated by separate independent means and is closed before the mold cavity is completely filled. As a criterion for closing the second venting valve, the length of the path can be used along which the casting piston runs during the filling operation.

7 Claims, 5 Drawing Sheets

METHOD AND APPARATUS FOR VENTING A DIECASTING MOULD OF A DIECASING MACHINE

FIELD OF THE INVENTION

The present invention refers to a method for venting a diecasting mould of a diecasting machine that is provided with a casting piston located in a pressure chamber and adapted for pressing liquid casting material into a mould cavity of the diecasting mould. The diecasting mould is provided with at least one venting channel communicating with the mould cavity. It comprises a first venting valve operationally connected to an impact transmitter exposed to and moved by the liquid casting material advancing from the mould cavity into the venting channel.

Moreover, the present invention refers to a valve assembly for venting a diecasting mould of a diecasting machine that is provided with a casting piston located in a pressure chamber and adapted for pressing liquid casting material into a mould cavity of the diecasting mould, whereby the diecasting mould is provided with a venting channel communicating with the mould cavity.

BACKGROUND OF THE INVENTION

In order to avoid the occurrence of trapped air in the finished cast work piece, the diecasting mould and the mould cavity of the diecasting mould, respectively, has to be vented during the diecasting operation. Thereby, it must be ensured that not only the air contained in the cavities of the diecasting machine and of the diecasting mould can escape, but it has also to be ensured that gases escaping from the liquid casting material can be removed as well.

In venting a diecasting mould, there is a problem insofar as the venting valve should be closed as late as possible in order to ensure that the mould cavity is vented, if possible, until it is completely filled; on the other hand, it should be avoided that liquid casting material can enter the venting valve. Taking this problem into account, venting assemblies have been disclosed in the prior art having a venting valve that is operationally connected to an impact transmitter operated by the liquid casting material advancing from the mould cavity into the venting channel. With the aid of such a design, very reliable valve assemblies can be realized that can be operated very quickly. In order to be able to build up a ram pressure at the impact transmitter sufficient to perform the closing operation, the venting channel comprises returns and cross sectional area variations. Moreover, the venting channel must have a certain minimal length between the impact transmitter and the real valve body member of the venting valve, and it should be full of corners in order to ensure that the venting valve is closed before the liquid casting material has reached the venting valve. By a design of the venting channel running between the impact transmitter and the venting valve that is full of corners, moreover, it can be avoided that splashes leading the real flow of casting material can enter the venting valve and block it. In order to increase the efficiency of such valve assemblies, usually a vacuum pump is connected to the venting valve.

PRIOR ART

The document EP 0 612 573 discloses a valve assembly referred to herein for venting diecasting moulds, comprising a venting channel, a venting valve located in the venting channel and an operating means for closing the venting valve. The operating means comprises an impact transmitter that is exposed to the liquid casting material advancing from the mould cavity into the venting channel. The impact transmitter is mechanically operationally coupled to the movable closure element of the venting valve. Thereby, the impact transmitter is designed as a push member hating an operating stroke that is limited to a fraction of the stroke to be passed through by the movable element of the venting valve. Moreover, the closure element of the venting valve is freely movable along the path exceeding the operating stroke of the impact transmitter, and the operating means comprises a power transmission member for transmitting the impact impulse from the impact transmitter to the movable closure member of the venting valve.

Even if such valve assemblies operate very reliably in practice, it would be desirable to increase the venting efficiency, particularly in the case of mould cavities having a large volume. The maximal venting efficiency is limited particularly by the turns and variations of the cross sectional area in the venting channel because thereby the flow resistance for the gases escaping from the mould cavity is substantially increased.

In order to solve the problems discussed herein above, it would be obvious to increase the cross sectional area of the already present venting valve and of the venting channel. However, tests conducted with such a design have shown that an increase of the cross sectional area of the valve and the venting channel doesn't offer the desired success because the flow resistance of the venting channel, due to its design full of corners, hinders an efficient venting as was always the case. An increase of the size of the venting valve, moreover, results in an increase of the mass of the movable parts of the valve assembly. Thus, consequently, the force required for closing the venting valve increases correspondingly, and/or the closure time of the venting valve increases to an undesired high value. Moreover, an increase of the cross sectional area of the venting valve and of the venting channel results in the fact that the dimensions of the valve assembly are increased as well; this is also not desired.

OBJECTS OF THE INVENTION

Thus, it is an object of the present invention to propose a method for venting the diecasting mould of a diecasting machine by which a higher venting efficiency can be achieved, still maintaining a reliable operation.

It is a further object of the invention to provide a valve assembly by means of which the method of the invention can be optimally performed.

SUMMARY OF THE INVENTION

To meet these and other objects, the present invention provides, in a first aspect, a method for venting a diecasting mould of a diecasting machine that is provided with a casting piston located in a pressure chamber and adapted for pressing liquid casting material into a mould cavity of the diecasting mould. The diecasting mould is provided with at least one venting channel communicating with the mould cavity. It comprises a first venting valve operationally connected to an impact transmitter exposed to and moved by the liquid casting material advancing from the mould cavity into the venting channel.

According to the invention, in a first step, the mould cavity and/or the pressure chamber is vented by means of a second venting valve in addition to the first venting valve during the step of pressing liquid casting material into the mould cavity of the diecasting mould. In a second step, the second venting valve is closed before the mould cavity is entirely filled with the liquid casting material, and in a third step, thereafter, the first venting valve is closed by the casting material advancing into the venting channel and hitting the impact transmitter.

With the method as outlined above, the venting efficiency can be considerably increased, because the provision of a second venting valve that is closed before the mould cavity is completely filled results in at least a doubling of the mean cross sectional area of the channels relevant for the venting efficiency, whereby simultaneously the venting channel portion leading to the second venting valve can be optimized as far as the flow resistance is concerned.

In a preferred embodiment of the method, the criterion for closing the second venting valve is constituted by the time elapsed since the start of the filling operation, or the position of the casting piston, or the path along which the casting piston has moved, or the fill rate of the pressure chamber, or the fill rate of the mould cavity. By this measure, it is ensured that the second venting valve is closed when the cast material has advanced up to it.

According to a second aspect, the invention provides a valve assembly for venting a diecasting mould of a diecasting machine that is provided with a casting piston located in a pressure chamber and adapted for pressing liquid casting material into a mould cavity of the diecasting mould. The diecasting mould is provided with a venting channel communicating with the mould cavity. The valve assembly comprises a first venting valve communicating with the venting channel and operationally connected to an impact transmitter. The impact transmitter is exposed to and moved by the liquid casting material advancing from the mould cavity into the venting channel. Further, there are provided a second venting valve communicating with the venting channel and separate, independent means for operating the second venting valve.

BRIEF DESCRIPTION OF THE DRAWINGS

In the following, the method according to the invention as well as an embodiment of the apparatus for performing the method according to the invention will be further described, with reference to the accompanying drawings, in which.

DETAILED DESCRIPTION OF A PREFERRED EMBODIMENT

With the aid of FIG. 1, the general design and the general mode of operation of an embodiment of the diecasting machine according to the invention as well as the valve assembly assigned thereto will be further explained, whereby only those characteristics and method steps will be discussed which are essential in connection with the present invention.

Figure 1:
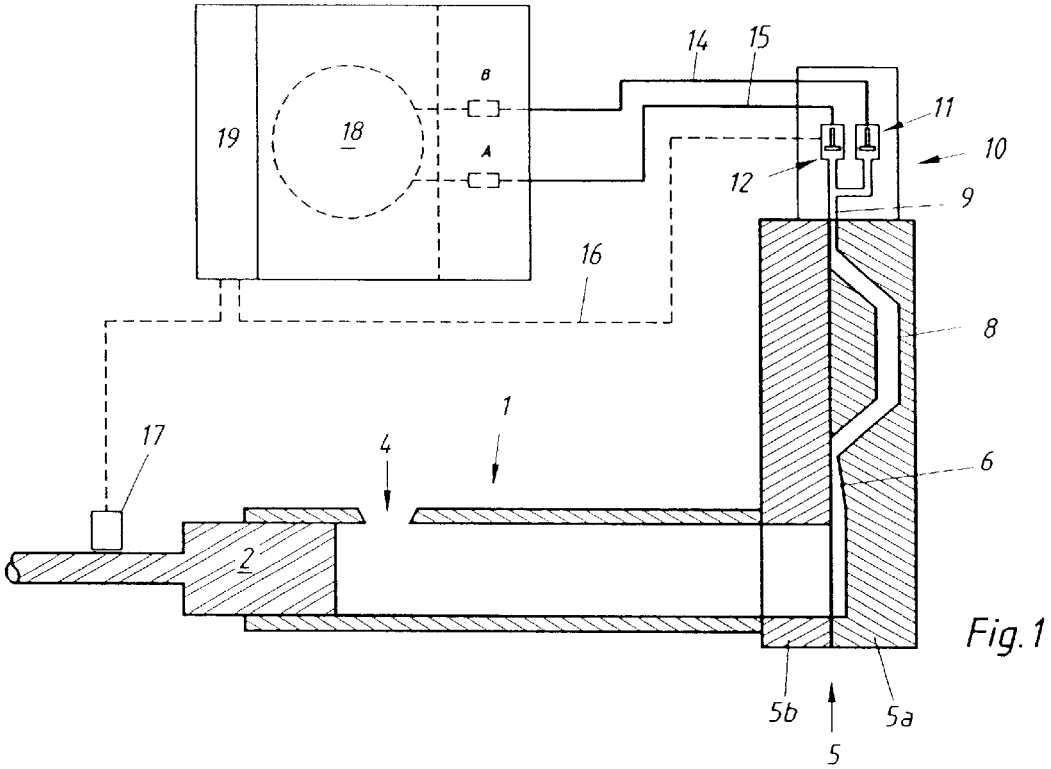
FIG. 1 shows a schematic cross sectional view of a diecasting machine, with a diecasting mould and a valve assembly mounted thereon, in the initial position.

As the essential components of the diecasting machine, in the present example, a pressure chamber 1 and a casting piston 2, located in the interior of the pressure chamber 1 and hydraulically driven, are illustrated in FIG. 1. The pressure chamber 1 is provided with a filling aperture 4 for filling the pressure chamber 1 with the liquid casting material. At the outlet end of the pressure chamber 1, a diecasting mould 5 is located which comprises two mould halves 5*a* and 5*b*. A connecting channel 6 runs from the pressure chamber 1 to the mould cavity 8 located between the two mould halves 5*a* and 5*b*. At the top side of the diecasting mould 5, a valve assembly 10 is disposed. A venting channel 9 interconnects the valve assembly 10 and the mould cavity 8. The valve assembly 10 is provided with two venting valves 11 and 12, respectively, that are connected to a vacuum pump 18 by means of two connecting pipes 14 and 15, respectively. Each of the connecting pipes 14, 15 is provided with a non-return valve A and B, respectively. The venting valve 11, located at the left side as seen in FIG. 1, is operatively connected to an impact transmission member that is not illustrated in FIG. 1, but will be further discussed herein below. The impact transmission member is operated by the diecasting material advancing from the mould cavity 8 into the venting channel 9. The left side venting valve 12 is operated by separate means; this is indicated in FIG. 1 by the dashed line 16, by means of which the venting valve 12 is connected to a control apparatus 19. In order to detect the position of the casting piston 2, there is provided a sensor 17 that is connected to the control apparatus 19 as well.

Figure 2:
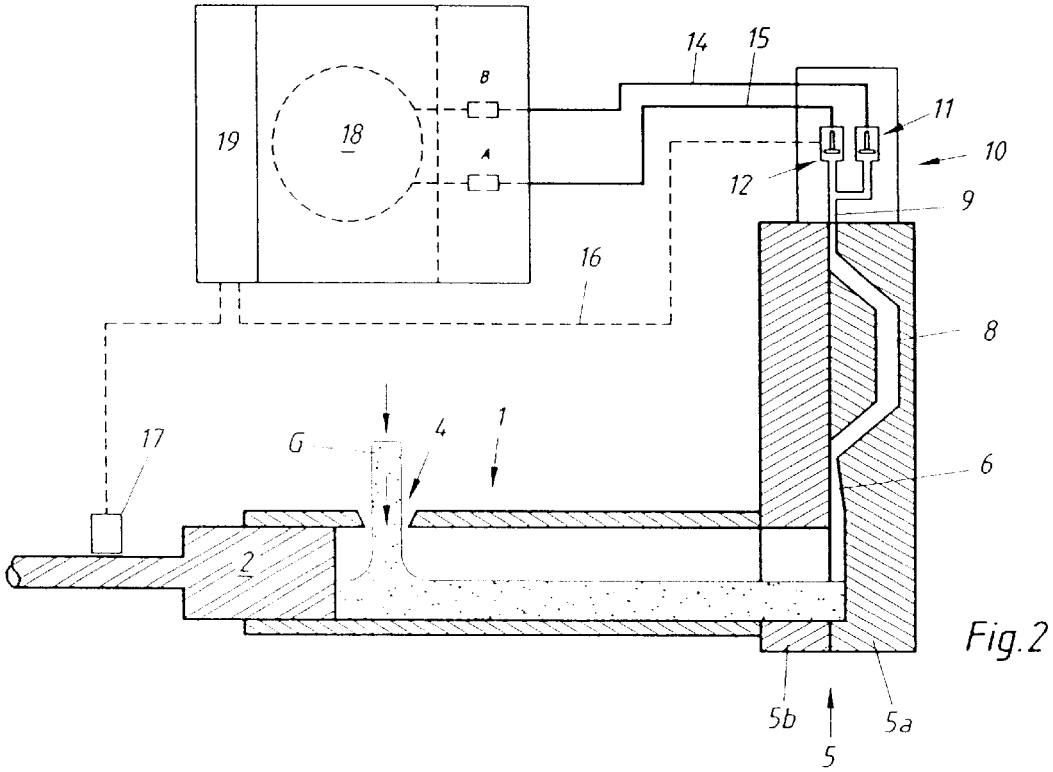
FIG. 2 shows a schematic cross sectional view of a diecasting machine, with a diecasting mould and a valve assembly mounted thereon, in a first phase of operation.

The FIGS. 2 to 5 show the diecasting machine and the valve assembly in four different phases of operation:

As can be seen in FIG. 2, in a first phase, the liquid casting material G is filled into the pressure chamber 1 via the filling aperture 4. Thereafter, the operation of feeding the liquid casting material G to the mould cavity 8 is initiated. For this purpose, the casting piston 2 is moved towards the right, as seen in FIG. 2, i.e. towards the diecasting mould 5.

Figure 3:
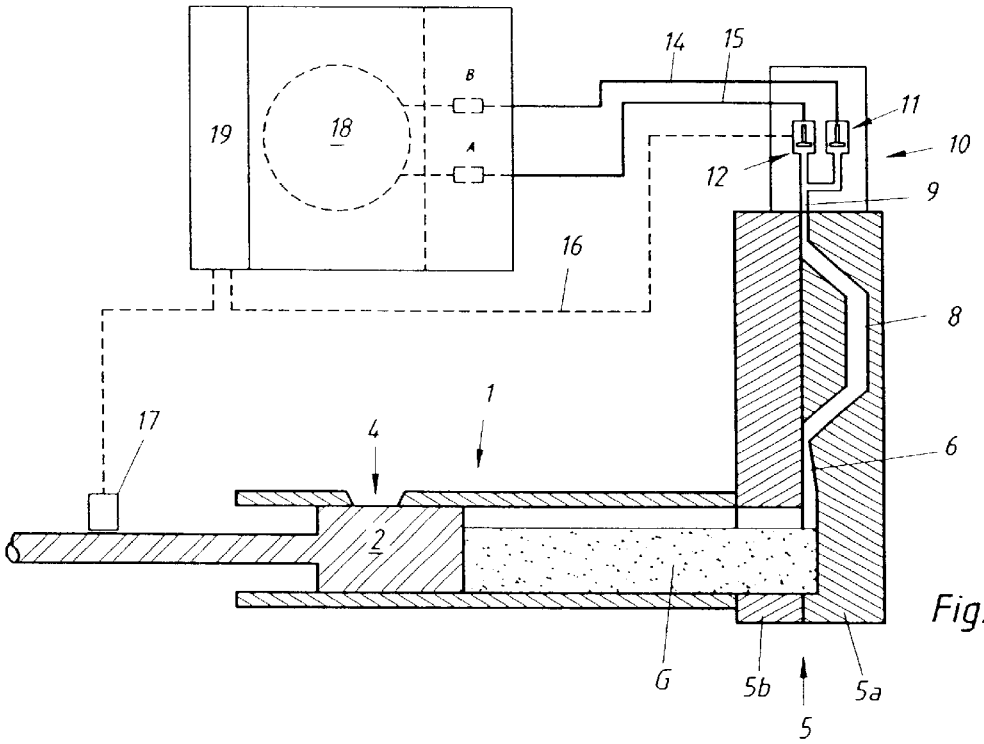
FIG. 3 shows a schematic cross sectional view of a diecasting machine, with a diecasting mould and a valve assembly mounted thereon, in a second phase of operation.

As can be seen in FIG. 3, in a second phase, the pressure piston has moved towards the diecasting mould 5 to such an extent that the filling aperture 4 is closed. At this time, the vacuum pump 18 is started and the two non-return valves A and B are opened. By this measure, the gases contained in the pressure chamber 1 and in the mould cavity 8 can escape and are sucked off, respectively, via the two opened non-return valves A and B.

Figure 4:
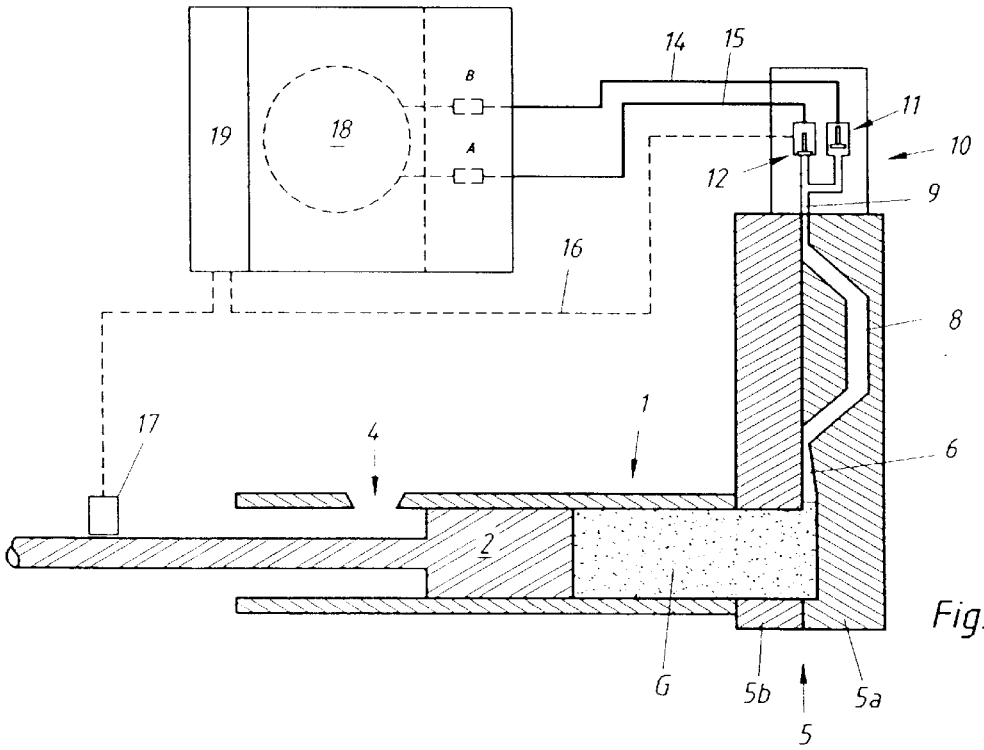
FIG. 4 shows a schematic cross sectional view of a diecasting machine, with a diecasting mould and a valve assembly mounted thereon, in a third phase of operation.

As can be seen in FIG. 4, in a third phase, the pressure piston has moved to the right, i.e. towards the diecasting mould 5, to such an extent that the portion of the pressure chamber 1 that is located to the right of the casting piston 2 is completely filled with the liquid casting material G. However, the liquid casting material has not yet reached the mould cavity 8. In this phase, the left side venting valve 12 is closed. This operation is performed pneumatically via the line 16.

As a criterion for closing the left side venting valve 12, the absolute position of the casting piston 2 is used in this example, since the fill rate of the pressure chamber 1 is known and can be calculated, respectively, on the basis of the geometry thereof, the amount of liquid casting material G that has been filled in and the absolute position of the casting piston 2. Because the mould cavity 8 is filled with casting material G. as a rule, within 20 to 80 milliseconds, the left side venting valve 12 is closed before the liquid casting material G has entered the mould cavity 8. It is understood that the left side venting valve 12 had to be closed only immediately before the liquid casting material G has reached it. This is the case as soon as the mould cavity 8 is completely filled and the casting material advances into the venting channel 9. In this case, however, there is a danger that splashes leading the real casting material G enter into the left side venting valve 12 and block it. Thus, these circumstances are taken into account by an early closing of the left side venting valve 12. Moreover, an early closing of the left side venting valve 12 offers the advantage that fluctuations of certain operation parameters are not critical for a reliable mode of operation of the valve assembly; such fluctuations are qualified by the principle of operation of such a diecasting machine, as for example a fluctuation of the amount of liquid casting material G filled into the pressure chamber 1. Moreover, a relatively simple control apparatus can be used. However, it is understood that the exact moment of closing the left side venting valve 12 can be adapted to the operating parameters present in any individual case.

Instead of the absolute position of the casting piston 2, also its relative position can be used as a criterion for closing the left side venting valve 12. Other possibilities are that the time elapsed since the start of the filling operation, the fill level of the pressure chamber 1 or the fill level of the mould cavity 8 are used as a criterion for closing the left side venting valve 12, whereby these examples are not final on no account.

Figure 5:
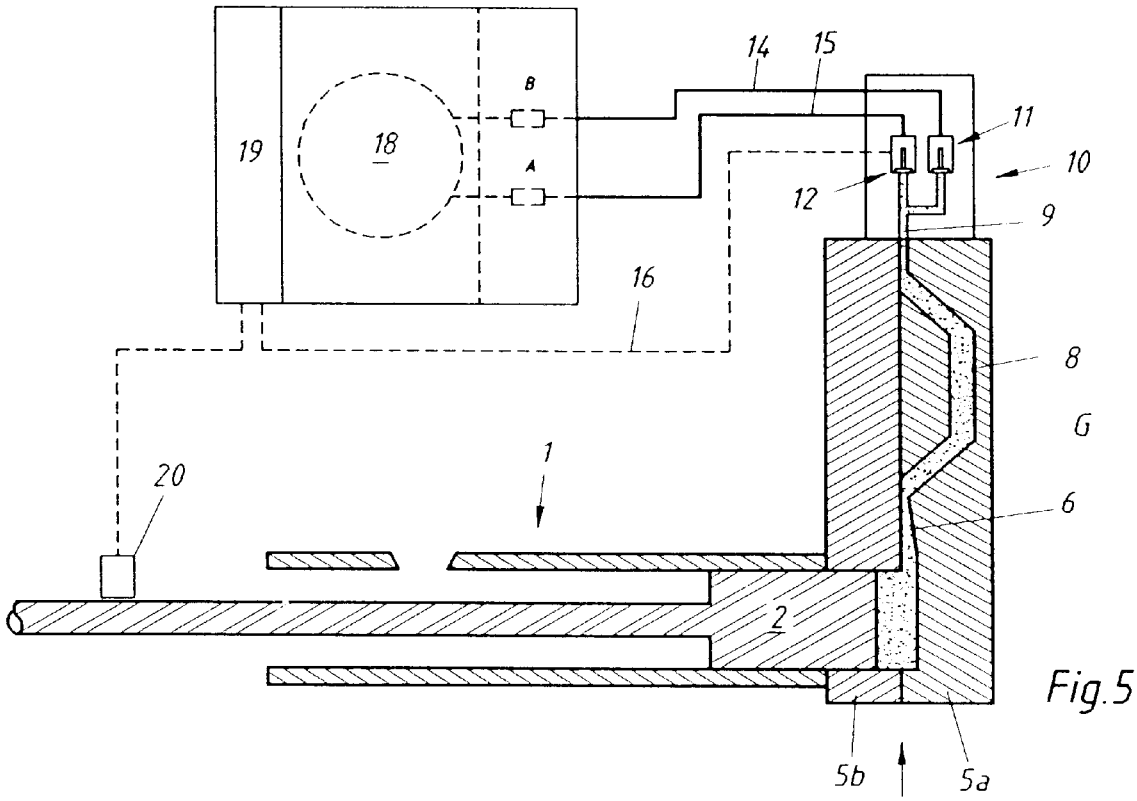
FIG. 5 shows a schematic cross sectional view of a diecasting machine, with a diecasting mould and a valve assembly mounted thereon, in a fourth phase of operation.

As the left side venting valve 12 has been closed, the non-return valve A of the vacuum pump 18 can be closed. Any gases still contained in the mould cavity 8 can escape and can be sucked off, respectively, via the right side venting valve 11. The right side venting valve 11 remains open until the casting material G advancing into the venting channel 9 has reached an impact transmitter not shown in FIGS. 2 to 5. As will be explained in more detail herein after, the impact transmitter, together with the valve body member of the right side venting valve 11, is moved and thereby the valve 11 closed by the kinetic energy contained in the moving casting material G. This fourth phase of operation is shown in FIG. 5.

Figure 6:
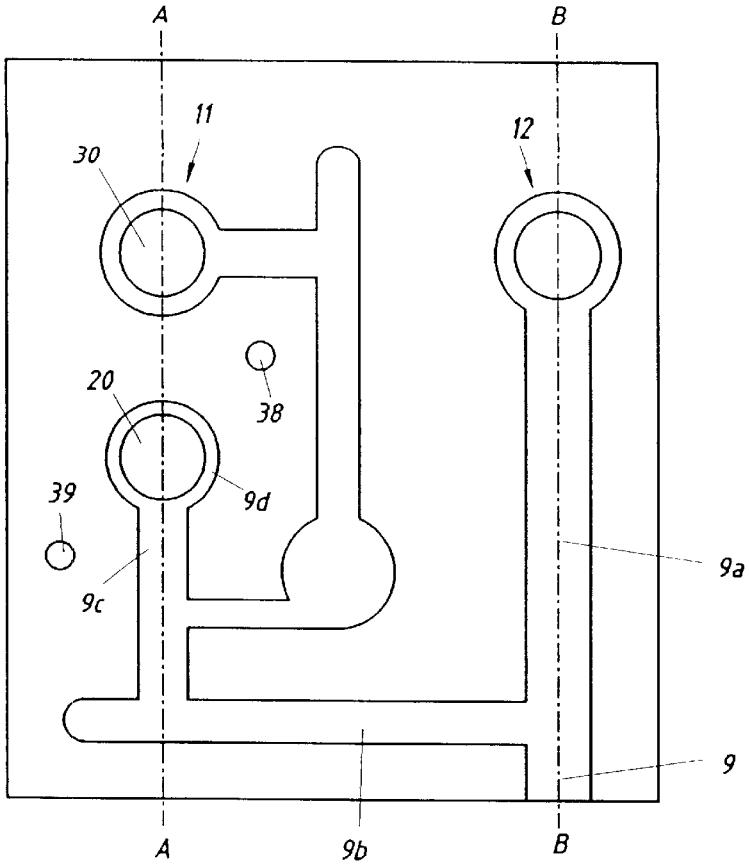
FIG. 6 shows a top view of the valve assembly in more detail.

FIG. 6 shows a top view of the valve assembly 10 in more detail. The venting channel running into the valve assembly 10 is designated with reference numeral 9, while the channel portion running to the first venting valve 11 is designated with reference numeral 9*b* and the channel portion running to the second venting valve 12 is designated with reference numeral 9*a*. The channel portion 9*a* running to the second venting valve 12 is of straight design in order to keep the flow resistance for the escaping gases as low as possible. The channel portion 9*b* running to the impact transmitter 20 and to the valve body member 30 of the first venting valve 11 is full of corners. This design of the channel portion 9*b* serves for catching splashes of casting material leading the real casting material G and for retarding the flow of the casting material G, after having reached the impact transmitter 20, in such a way that the valve body member 30 has reached its closed position in time, before the casting material has advanced up to the valve body member 30. The impact transmitter 20 is located at the end of a side branch 9*c* of the channel portion 9*b*. Moreover, a damming chamber 9*d* is provided in the region of the impact transmitter 20 in which the impact pressure can be set up that is required for the closure movement of the impact transmitter 20 and the elements operationally connected to the impact transmitter 20. Moreover, two push rods 38 and 39 are illustrated that are provided for biasing a spring assembly not visible in the illustration of FIG. 6.

Figure 7:
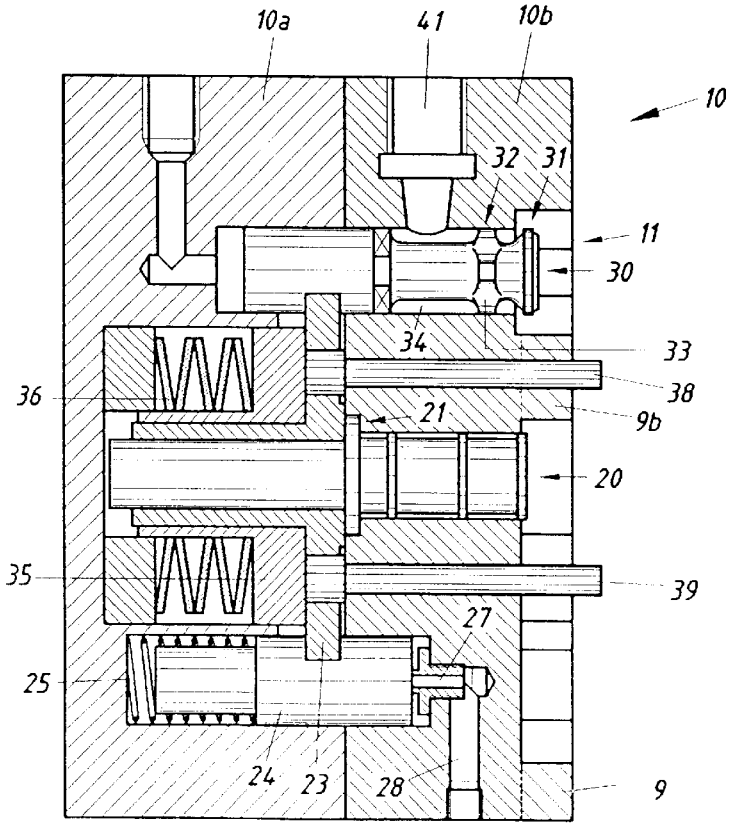
FIG. 7 shows a first cross sectional view of the valve assembly shown in FIG. 6, taken along the line A—A in FIG. 6.

FIG. 7 shows a cross sectional view of the valve assembly 10, taken along the line A—A in FIG. 6; thereby, the valve assembly 10 is in its rest position. For a better understanding, the two push rods 38, 39 are shown as being located in a common vertical plane.

Besides the impact transmitter 20, the valve body member 30 received in a valve channel 34 and the two push rods 38, 39 this illustration also shows a working piston 24 biased by means of a spring member 25, a poppet valve 27, a driver plate 23, a pressure plate member 35 as well as a spring assembly 36. The valve body member 30 comprises a collar 32 provided with axial recesses 33 through which the gases coming from the venting channel portion 9*b* can pass to get into an outlet channel 41 located above the valve body member 30 and connected to the vacuum pump 18. The impact transmitter 20 is provided with a collar 21 that engages the driver plate 23 upon a movement in backward direction. The upper side of the driver plate 23 engages the valve body member 30, and its lower side engages the working piston 24. On the back side of the driver plate, the spring assembly 36 is located that urges, by means of the pressure plate member 35, the impact transmitter 20 as well as the valve body member 30 and the working piston 24 into a forward rest position, as is shown in FIG. 7. The spring assembly 36 is biased upon mounting the valve assembly 10 in the diecasting machine by means of the push rods 38, 39 that pass through the driver plate 23. Thus, the impact transmitter 20 can be moved backwards under the influence of the kinetic energy contained in the casting material G hitting the impact transmitter, as will be explained in more detail herein below.

The closure movement path of the impact transmitter 20 is limited to a fraction of the closure movement paths of the valve body member 30 and the working piston 24. For this reason, the kinetic energy transmitted from the casting material G to the movable parts 20, 23, 24 and 30 can be kept within certain reasonable limits. In order to move the valve body member 30 from the open position, as shown in FIG. 7, to the closed position, the impact transmitter 20 has to transmit but an impact momentum. By this impact momentum, the driver plate 23 together with the valve body member 30 and the working piston 24 are moved in an idling manner up to their final position. For supporting the closure movement, and/or in order to keep the working piston 24, the driver plate 23 and the valve body member 30 in their final positions, the working piston 24 can be subjected to a pneumatic force by pressurized air supplied via an air channel 28. As soon as the working piston 24 has left the poppet valve 27, the entire front face of the working piston is subjected to the pressurized air; thereby, the closure movement is supported and the working piston 24 is kept in its final position, respectively.

Figure 8:
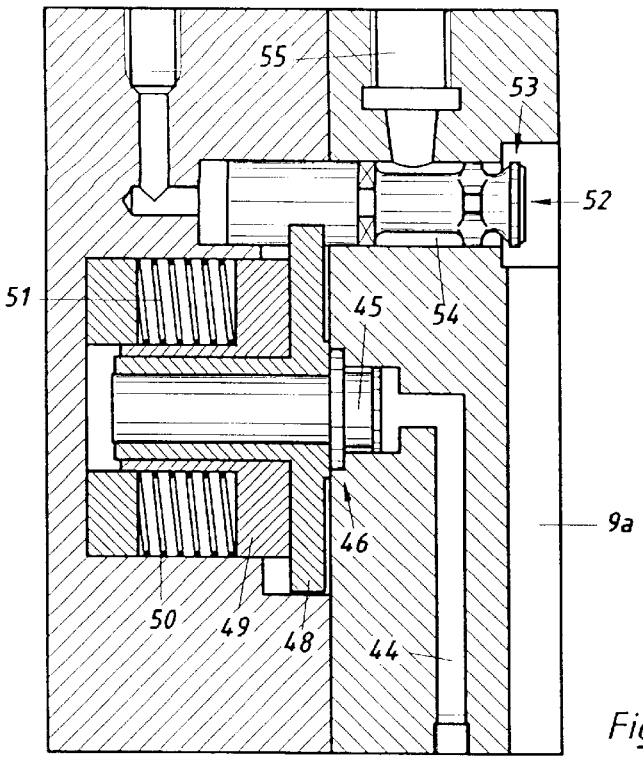
FIG. 8 shows a second cross sectional view of the valve assembly shown in FIG. 6, taken along the line B—B in FIG. 6.

FIG. 8 shows a cross sectional view, taken along the line B—B in FIG. 6, of the second venting valve 12 of the valve assembly 10. The venting valve 12 comprises a closure piston 45, a driver plate 48, a pressure plate 49, two spring members 50, 51 as well as a valve body member 52 received in a valve channel 54. Again, the movable closure piston 45 is provided with a collar 46 that engages the driver plate 48 upon a backward movement. The driver plate 48 is operationally connected to the valve body member 52 by engaging the valve body member 52 with its upper side. The driver plate 48, together with the valve body member 52 and the closure piston 45, is pushed forward by means of the two spring members 50 and 51. In order to move the valve body member 52 from the open position, as shown in FIG. 8, to its closed position, a pressure medium is fed via a channel 44 leading to the closure piston 45. That pressure medium effects on the front face of the closure piston 45 and moves it, together with the driver plate 48 and the valve body member 52, against the force of the spring members 50, 51 in backwards direction towards an end stop member. Thereby, the head 53 of the valve body member 52 advancing into the valve channel 54 seals the valve channel 54.

Due to the measure that the second venting valve 12 is operated by separate independent means, the venting channel portion 9*a* running to the venting valve 12 can be straight, with the result of a very low flow resistance. However, it must be ensured that the second venting valve 12 is closed before the casting material has advanced up to it.

Figure 9:
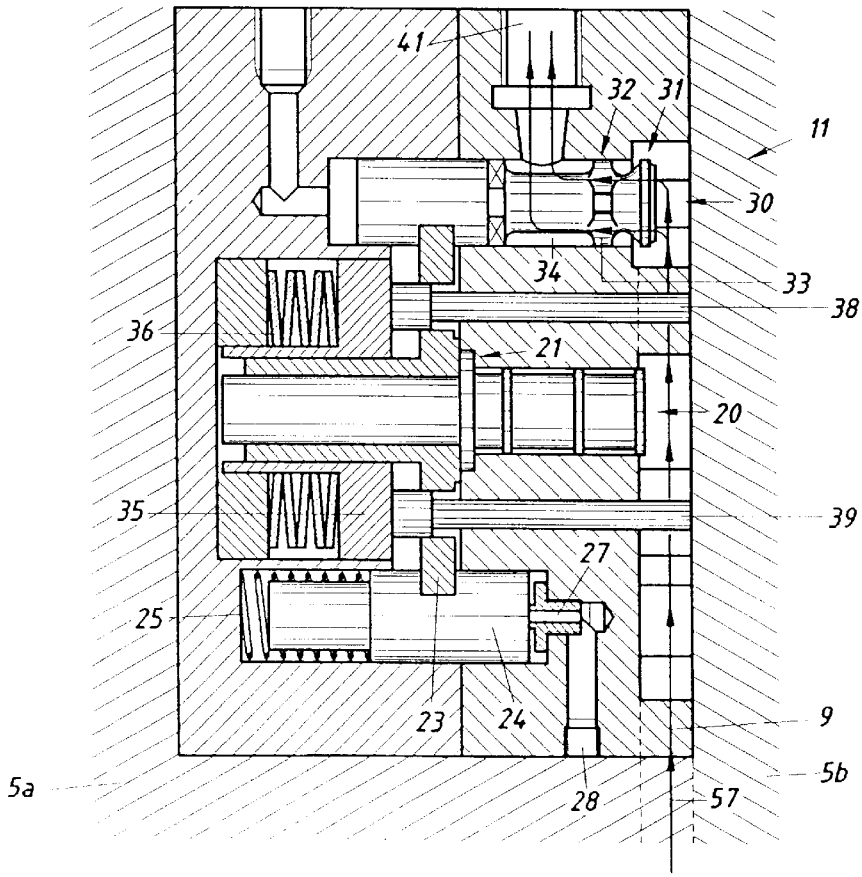
FIG. 9 shows a cross sectional view of the valve assembly, mounted in a diecasting machine, taken along the line A—A in FIG. 6.

FIG. 9 shows a cross sectional view, taken along the line A—A in FIG. 6, of the valve assembly when mounted on a diecasting mould 5 consisting of two halves 5*a* and 5*b*. In the mounted position as shown in FIG. 9, the spring assembly 36 is biased by means of the two push rods 38 and 39 that abut against one of the halves 5*b* of the diecasting mould 5. Furthermore, the valve body member 30 is in its open position, namely under the influence of the spring member 25 of the working piston 24. Thus, gases contained in the mould cavity 8 can flow to the outlet channel 41 via the venting channel 9 and the valve channel 34, as indicated by arrows 57 in FIG. 9. As soon as the casting material G has reached the impact transmitter 20, the latter one is suddenly moved to its end stop under the impact of the casting material hitting its front face. The collar 21 provided on the impact transmitter 20 transmits this impact force to the driver plate 23. The driver plate 23 is released from the impact transmitter under the influence of the kinetic energy transferred from the impact transmitter 20 to the driver plate 23, as soon as the impact transmitter has reached its end position, and continues its movement, together with the valve body member 30 and the working piston 24, against the force of the closure spring member 25. Thereby, the venting valve 11 is closed while the head 31 of the valve body member advances into the valve channel 34. The closure movement of the venting valve 11 is supported by the force of a pressure medium effecting to the closure piston 24. That pressure medium effects to the entire front face of the closure piston 24 as soon as the closure piston has been released from the control valve 27. However, it must be stated that the venting valve 11 can be closed, as a rule, even without the support of the working piston 24, since the energy required for the closure movement of the venting valve 11 is raised by the liquid casting material G advancing from the mould cavity 8 into the venting channel 9.

After hardening of the casting material G, the right side half 5*b* of the casting mould 5 is removed. Thereby, the air gate is ejected by means of the two push rods 38, 39 that are under the influence of the spring assembly 36.

By means of a valve assembly 10 as explained herein before, the venting efficiency can be substantially increased, as compared to conventional venting valve assemblies, simultaneously avoiding that the valve assembly will become substantially bigger. A particularly reliable mode of operation can be ensured by the two-stage venting method, in which the one venting valve 12 is operated by separate, independent means before the mould cavity is completely filled and in which the other venting valve 11 is operated by the liquid casting material advancing from the mould cavity 8 into the venting channel 9.

What is claimed is:

1. A valve assembly for venting a diecasting mould of a diecasting machine that is provided with a casting piston located in a pressure chamber for pressing liquid casting material into a mould cavity of said diecasting mould, said diecasting mould being provided with a venting channel communicating with said mould cavity, said valve assembly comprising:

a first venting valve communicating with said venting channel, an impact transmitter operationally connected to said first venting valve, said impact transmitter being exposed to and moved by said liquid casting material advancing from said mould cavity into said venting channel, said impact transmitter closing said first venting valve when said impact transmitter is moved by said liquid casting material;

a second venting valve communicating with said venting channel; and separate, independent means for operating said second venting valve, said impact transmitter, said first venting valve and said second venting valve being positioned downstream of said mould cavity;

said venting channel including an essentially straight first venting channel portion, said second venting valve being located at the end of said essentially straight first venting channel portion;

said venting channel including a second venting channel portion that has corners, said first venting valve being located in said second venting channel portion.

2. A valve assembly according to claim 1 in which said essentially straight first venting channel portion and said second venting channel portion communicate with a common venting channel.

3. A valve assembly according to claim 1 in which the cross sectional area of said straight first venting channel portion is greater than the mean cross sectional area of said second venting channel portion.

4. A valve assembly according to claim 1 in which said impact transmitter is located in said second venting channel portion that has corners, whereby said impact transmitter is located before said first venting valve, as seen in the flow direction of the casting material.

5. A valve assembly according to claim 1 in which said first and second venting valves each have a valve body member, said impact transmitter is a push member having an operating stroke that is limited to a fraction of the stroke of the valve body member of said first venting valve, whereby the valve body member of said first venting valve is movable along a path exceeding the operating stroke of said impact transmitter.

6. A valve assembly according to claim 1 in which said first and second venting valves each have a valve body member, and said valve assembly includes a first portion and a second portion, each of the valve body members of said first and second venting valves being biased by spring means resting on one of said first and second valve assembly portions.

7. A valve assembly according to claim 1, further comprising sensor means for determining the position of said casting piston, or for determining the length of the path through which said casting piston has run, or for determining the time elapsed since the start of the filling operation, or for determining the fill rate of said mould cavity, said sensor means actuating said separate, independent means.

* * * * *